US009277772B2

(12) United States Patent
Gibbard et al.

(10) Patent No.: US 9,277,772 B2
(45) Date of Patent: Mar. 8, 2016

(54) GARMENT FOR SUPPORTING A WEARER'S BREASTS

(75) Inventors: Kylie Margaret Gibbard, Levin (NZ); Darrell John Stratton, Levin (NZ)

(73) Assignee: MK Girl Limited, Levin (NZ)

( * ) Notice: Subject to any disclaimer, the term of this patent is extended or adjusted under 35 U.S.C. 154(b) by 490 days.

(21) Appl. No.: 13/813,755

(22) PCT Filed: Aug. 2, 2010

(86) PCT No.: PCT/NZ2010/000155

§ 371 (c)(1),
(2), (4) Date: Apr. 8, 2013

(87) PCT Pub. No.: WO2012/018263

PCT Pub. Date: Feb. 9, 2012

(65) Prior Publication Data

US 2013/0205464 A1 Aug. 15, 2013

(51) Int. Cl.

| | |
|---|---|
| ***A41C 3/00*** | (2006.01) |
| *A41C 1/06* | (2006.01) |
| *A41D 7/00* | (2006.01) |

(52) U.S. Cl.

CPC ..... *A41C 3/00* (2013.01); *A41C 3/0021* (2013.01); *A41C 1/06* (2013.01); *A41C 3/0007* (2013.01); *A41D 7/00* (2013.01)

(58) Field of Classification Search

CPC ..... A41C 3/00; A41C 3/0021; A41C 3/0035; A41C 3/0057; A41C 3/0064; A41C 5/00

USPC ..... 450/30–33, 92, 93.64–93.69, 74–76, 450/60, 61; 66/171, 172 E, 172 R, 169 R; 2/73, 105, 106, 113, 115

See application file for complete search history.

(56) References Cited

U.S. PATENT DOCUMENTS

| | | | |
|---|---|---|---|
| 2,949,916 | A | 8/1960 | Paveza |
| 4,254,777 | A | 3/1981 | Johnston |
| 4,289,137 | A | 9/1981 | Dell et al. |
| 4,295,469 | A | 10/1981 | Lindgren |
| 4,298,008 | A | 11/1981 | Kylberg |
| 4,311,150 | A | 1/1982 | Schreiber et al. |

(Continued)

FOREIGN PATENT DOCUMENTS

GB 1210548 A 10/1970

OTHER PUBLICATIONS

International Searching Authority; "International Search Report" and "International Preliminary Report on Patentability;" PCT/NZ2010/000155; Dec. 21, 2010.

*Primary Examiner* — Gloria Hale
(74) *Attorney, Agent, or Firm* — Stoel Rives LLP

(57) ABSTRACT

A garment for supporting a wearer's breasts has a band for encircling a wearer's torso and a pair of cups for receiving at least a major part of a wearer's breast, and a pair of shoulder straps, each shoulder strap extending from a corresponding cup to a back portion of the garment. The garment has a pair of panel portions, each panel portion extending between the band and a corresponding cup of the pair of cups. Each panel portion has a folding portion that is foldable relative to the pair of cups so that the folding portions lie between a wearer's breasts and a wearer's torso, in use. The band, the shoulder straps and the panel portions are arranged such that the weight of a wearer's breasts are supported by both the shoulder straps and the band.

30 Claims, 11 Drawing Sheets

(56) References Cited

U.S. PATENT DOCUMENTS

| | | | | |
|---|---|---|---|---|
| 4,699,144 | A | 10/1987 | Sherwood | |
| 5,479,791 | A * | 1/1996 | Osborne | 66/171 |
| 5,980,359 | A | 11/1999 | Brown | |
| 6,113,460 | A | 9/2000 | McKeown | |
| 6,406,353 | B1 | 6/2002 | Harper | |
| 6,439,959 | B1 | 8/2002 | Magrone et al. | |
| 6,477,365 | B2 | 11/2002 | Fukuda | |
| 6,544,101 | B1 | 4/2003 | von Sydow et al. | |
| 7,267,599 | B2 | 9/2007 | Allen et al. | |
| 7,491,113 | B2 * | 2/2009 | Bowler | 450/60 |
| 8,326,398 | B2 * | 12/2012 | Weinstock | 600/407 |
| 8,550,872 | B2 * | 10/2013 | Upton et al. | 450/66 |
| 2006/0057937 | A1 * | 3/2006 | Bowler | 450/61 |
| 2008/0305714 | A1 | 12/2008 | Sobah-Wilhelm | |
| 2010/0022165 | A1 | 1/2010 | Silverman et al. | |
| 2013/0045661 | A1 * | 2/2013 | Armanino | 450/31 |

* cited by examiner

GARMENT FOR SUPPORTING A WEARER'S BREASTS

RELATED APPLICATIONS

This application is a National Stage of International Patent Application No. PCT/NZ2010/000155, filed Aug. 2, 2010, which is incorporated herein by reference in its entirety.

FIELD OF THE INVENTION

This invention relates to a garment for supporting a wearer's breasts.

BACKGROUND OF THE INVENTION

Bras provide support and enhance the shape of breasts. There has been a long sought need for an adequate supportive bra for women with a natural droop in their breasts. Conventional bras do not meet the needs of women whose breasts have acquired a natural droop in their breast due to size, breastfeeding, breakdown of breast tissue or any number of other causes.

Conventional bras are designed to try to defy gravity and uplift a wearer's breasts to create pert, non-sagging breasts. However, it is impossible to create completely upward sloping breasts out of breast tissue that has a natural droop. A woman with naturally dropping breasts must put her breasts into conventional bras that are unlikely to fit as well as they would on a wearer with non-sagging breasts. If it was physically possible to fit naturally drooping breasts into a conventional bra, and have the bra fit and work as it was designed to, women with naturally drooping breasts would have breasts poking straight out in the air, a significant distance out in front of them.

As a result of the natural droop in most women's breasts, conventional bras sit at the lowest sagging point of the breast tissue and try to pull the breast up from that lowest point. Not only does this result in a bra that doesn't fit properly, but it also results in several major design problems. An example of a conventional bra is shown in FIGS. 1A and 1B and is indicated generally by reference number 100. A conventional bra has a band 103, a pair of cups intended for receiving a wearer's breasts 105, and shoulder straps 109.

Firstly, all the weight of the breast B hangs completely on the shoulder strap 109; the resulting pressure on the shoulders of the wearer over time often results in large grooves in the shoulder tissue of the wearer as well as shoulder pain, aching and discomfort, as shown in FIG. 1A. This is an ever greater problem for wearers of conventional bras with larger breasts.

Secondly, the lower section of the bra rubs on the ribcage or torso T of the wearer as the natural droop breast moves during daily life activities to a much greater degree when compared with a firmer non drooping breast. This is again, an even greater problem for wearers with large natural droop breasts where women are known to be rubbed raw from the repeated daily rubbing movement of a conventional bra. This greater range of movement of the naturally drooping breast also means that the lace and overlay fabrics placed on conventional bras around the lower cup and arm sections of the bra results in an even greater chafing effect.

Thirdly, with the complete breast tissue of a naturally drooping breast not being fully enclosed in the cups 105 of a conventional bra, the underside of the breast B that touches the ribcage is not supported at all, as shown in FIG. 1B. This exacerbates the drooping of the breast as there is even more chance of a breakdown of the breast tissue resulting in further sagging.

Furthermore, in conventional bras, breasts that have a natural droop are prone to the significant issue of the wearer's breast tissue "climbing out" of the bra when any physical or bending down activity occurs. It can even result in the breast tissue completely coming out over top of the bra. Even with the wearer wearing a correctly sized bra, this happens because a breast with natural droop has a much greater range of movement during normal everyday activities than a firmer breast with no droop. The "four breast" look that results from breasts "climbing out" can at its worst result in serious health issues caused by damage to the breast tissue, and at its best be uncomfortable and look unsightly and unattractive.

Conventional bras often have a device at the lower edge of the cups to provide support. These devices are commonly known as underwires 107 and are inserted into and held within a fabric sleeve disposed about the periphery of the lower section of the bra cup. They are made from materials, such as bone, metal or plastic and are provided in various forms, shapes and cross-sections. Most commonly, the underwire is formed of relatively thin metallic pieces of rectangular cross section, shaped into essentially semi-circular or U-shaped for that allows the underwire to be fitted within a sleeve disposed about the periphery of the lower half of the bra cup.

These underwire structures have achieved widespread usage; however, a number of significant disadvantages can result from their usage in conventional bras when the breast has a natural droop. In particular due to the natural droop of the breast and the inability of conventional bras to encompass the whole breast, the rigid nature of underwires irritate and further amplify the rubbing and chafing effect of the conventional bra on the ribcage of the wearer.

The daily movement range of a breast with natural droop and the fact that the underwire is required to undertake the strain of the whole weight of the natural droop breast in an effort to pull the breast tissue up towards the shoulder, can result in the underwires snapping. This snapping of the underwires has been known to cause small stab wounds in the breast tissue or rib cage when the broken underwire pokes through the sleeve casing. The weight of the breast tissue with a natural droop breast sitting on conventional bras can also result in a distorting of the underwire outwards resulting in the underwire poking into skin of the wearer under the arms leading to discomfort and sometimes bruising. FIG. 1B shows the position of an underwire 107 of a conventional bra relative to the wearer's breast B, which contributes to the discomfort experienced by the wearer.

The placement of the straps 109 on a conventional bra also often results in the shoulder straps falling off the wearer's shoulders. This is due to the wide strap placement of straps on a conventional bra. Also a factor is the greater range of movement of the naturally drooping breast can put uneven pressure on the bra strap and when combined with the already wide placement of the straps of a conventional bra the strap moves and slides off.

With conventional bras that are made for larger cup sizes, the grading or sizing of the bras is-often just a smaller bra with every pattern piece made larger. When undertaking this grading or sizing of conventional bras, no changes are made to the base cup shape and strap placement and the resulting large cup sized conventional bras end up with very wide shoulder strap placement. No allowance is made for the fact that even though the wearer of the bra has larger breasts, they do not in fact have wider shoulders. This further exacerbates the underlying problem of shoulder straps falling off while wearing conventional bras for wearers with naturally drooping breasts. For women with naturally drooping breasts who also have a large cup size and a large rib size this is an even greater problem.

An adequate supportive and comfortable bra for any woman with a natural droop in her breasts is not available in the market.

An object of at least preferred embodiments of the invention is to provide a garment that addresses at least one of the issues discussed above and/or to at least provide the public with a useful choice.

SUMMARY OF THE INVENTION

In accordance with a first aspect of the invention, there is provided a garment for supporting a wearer's breasts comprising:

a band for encircling a wearer's torso;

a pair of cups for receiving at least a major part of a wearer's breasts;

a pair of shoulder straps, each shoulder strap extending from a corresponding cup to a back portion of the garment;

and a pair of panel portions, each panel portion extending between the band and a corresponding cup of the pair of cups, each panel portion having a folding portion that is foldable relative to the pair of cups so that the folding portions lie between a wearer's breasts and a wearer's torso, in use;

wherein the band, the shoulder straps and the pair of panel portions are arranged such that the weight of a wearer's breasts are supported by the shoulder straps and the band.

The term "comprising" as used in this specification means "consisting at least in part of"; that is to say when interpreting statements in this specification which include "comprising", the features prefaced by this term in each statement all need to be present but other features can also be present. Related terms such as "comprise" and "comprised" are to be interpreted in a similar manner.

In an embodiment, each of the cups has a lower portion that is arranged to extend at least partly over the panel portions when the folding portions of the panel portions are folded.

In an embodiment, each of the cups has a lower portion arranged to extend over the panels and at least partly over the band when the folding portions of the panel portions are folded.

In an embodiment, the lower portion of each cup has a generally rounded three-dimensional shape. The lower portion of each cup may be formed from panels that are connected together with arcuate seams to form the generally rounded three-dimensional shape.

In an embodiment, the garment further comprises underwires with a respective underwire disposed about a lower periphery of each cup.

In an embodiment, each cup comprises a substantially elastic material. Each cup preferably comprises a spandex or elastane material.

In an embodiment, the panel portions comprise a substantially elastic material. The panel portions preferably comprise a spandex or elastane material.

In an embodiment, each of the cups comprises a sternum portion that is a relatively flat compared to the remainder of the cup. The relatively flat sternum portion may be formed by an upwardly angled seam that has a first end positioned close to the centre of the garment and a second end spaced a distance away from the centre of the garment, the first end being positioned higher than the second end, when the garment is viewed from the front. The relatively flat sternum portion may be formed by an arcuate seam between the lower portion of the cup and an upper portion of the cup. The arcuate seam may be concave when viewed from the upper portion of the cup.

In an embodiment, the band has a height of about 19 mm to about 60 mm. The band has a height of about 32 mm.

In an embodiment, the band comprises a substantially elastic material. The band may comprise a non-roll substantially elastic material.

In an embodiment, the garment further comprises a folded hem encasing the band.

In an embodiment, the shoulder straps each comprise a padded portion.

In an embodiment, each of the shoulder straps is substantially aligned with a centre of each of the cups.

In an embodiment, the cups are formed from two or more portions sewn together.

In an embodiment, the garment further comprises a panel extending from at or near the band in a direction substantially parallel to the band and away from the band. The garment may be a corset. Alternatively, the garment may be a swimsuit.

In an embodiment, the garment further comprises a panel extending over at least a major part of the pair of cups, over the band and in a direction substantially parallel to the band and away from the band. The garment may be a camisole or singlet. Alternatively, the garment may be a shirt or blouse. In a further alternative, the garment may be a swimsuit.

In accordance with a second aspect of the invention, there is provided a method of supporting a wearer's breasts, the method comprising the steps of:

a) providing a garment having a band for encircling a wearer's torso, a pair of cups for receiving a major part of a wearer's breasts, a pair of shoulder straps, each shoulder strap extending from a corresponding cup to a back portion of the garment, and a pair of panel portions, each panel extending between the band a corresponding cup of the pair of cups, the panel having folding portions that are foldable relative to the pair of cups, b) placing the garment on a wearer such that the band encircles a wearer's chest, a major part of a wearer's breasts are received by the pair of cups, each shoulder strap extending over the wearer's shoulders, and the folding portions are folded to lie between a wearer's breasts and a wearer's torso, and c) supporting the weight of a wearer's breasts by the shoulder straps and the band.

In an embodiment, each of the cups of the garment provided in step a) has a lower portion, the method further comprising: allowing the lower portion of each of the cups to extend at least partly over the panel when the folding portions of the panel are folded.

In an embodiment, each of the cups of the garment provided in step a) has a lower portion, the method further comprising: allowing the lower portion of each of the cups to extend at least partly over the band when the folding portion of the panel is folded.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

As used herein the term "(s)" following a noun means the plural and/or singular form of that noun.

As used herein the term "and/or" means "and" or "or", or where the context allows both. The invention consists in the foregoing and also envisages constructions of which the following gives examples only.

BRIEF DESCRIPTION OF THE DRAWINGS

The present invention will now be described by way of example only and with reference to the accompanying drawings in which.

DETAILED DESCRIPTION OF EMBODIMENTS OF THE INVENTION

Figure 1A:
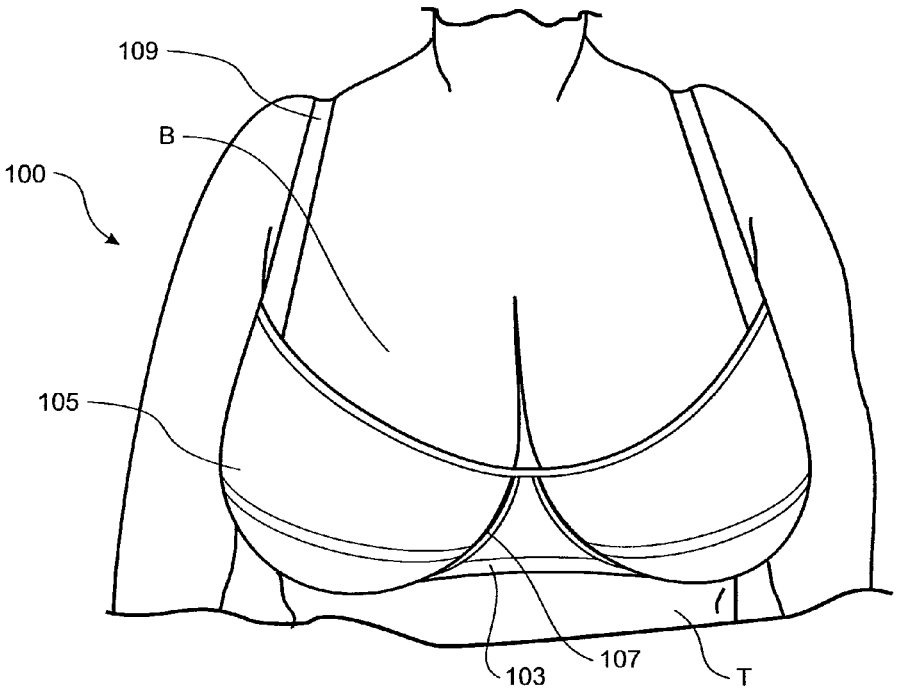
FIG. 1A is a front view of a conventional bra being worn by a wearer with naturally drooping breasts.
Figure 1B:
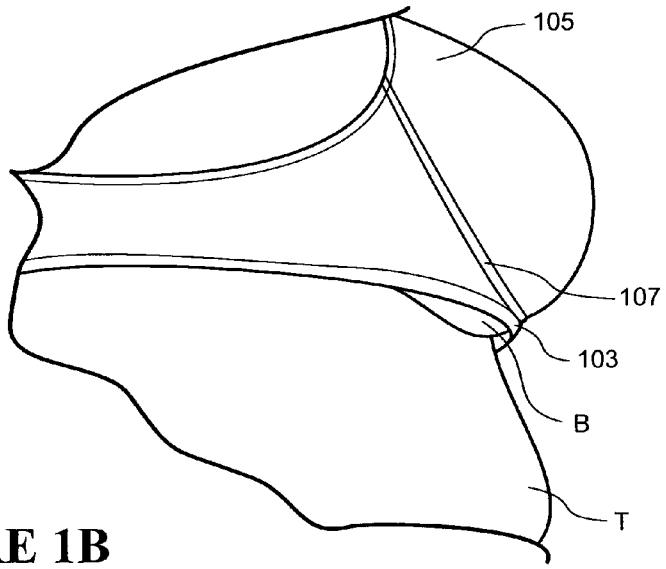
FIG. 1B is a side view of the conventional bra of FIG. 1A.
Figure 2:
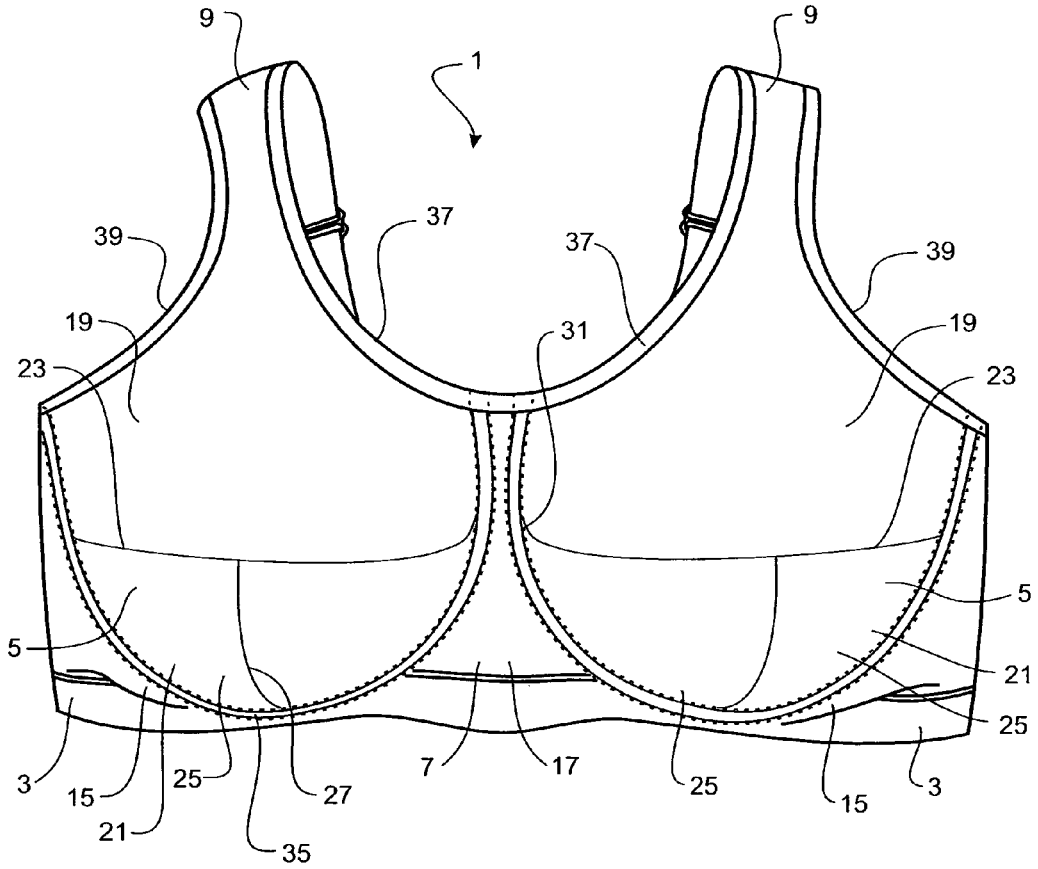
FIG. 2 is a front view of a first embodiment of the garment for supporting a wearer's breasts, not being worn.
Figure 3A:
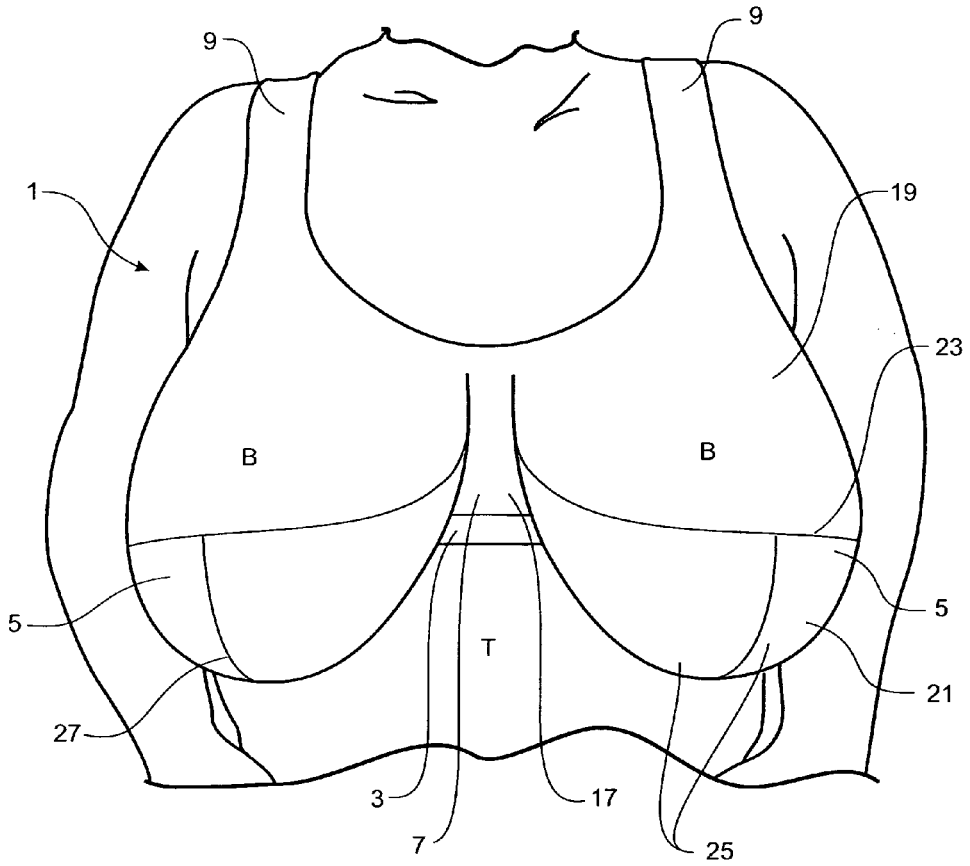
FIG. 3A is a front view of the garment for supporting a wearer's breasts of FIG. 1, as worn.
Figure 3B:
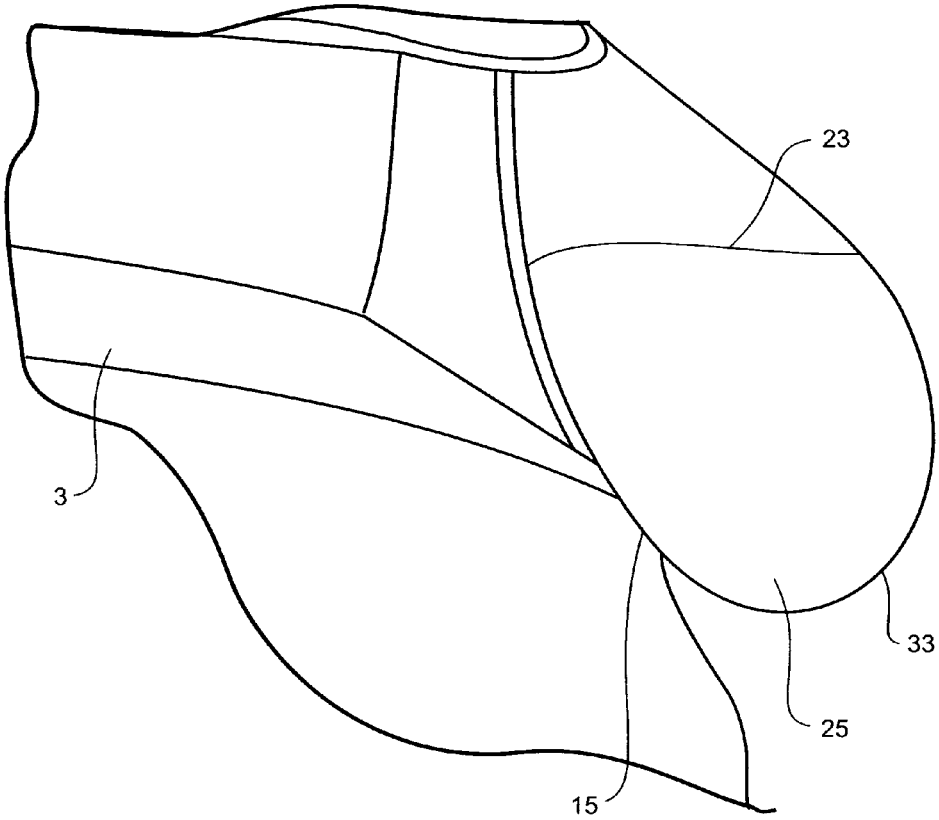
FIG. 3B is a side view of the garment for supporting a wearer's breasts of FIG. 1, as worn.

Referring to FIGS. 2, 3A and 3B, a preferred embodiment for supporting a wearer's breasts is shown, indicated generally by reference number 1. The garment 1 has a band 3 for encircling a wearer's torso T, a pair of cups 5 for receiving a wearer's breasts B, and a pair of panel portions between the band and the pair of cups. In the embodiment shown, the panel portions are integrally formed as a single panel 7. The garment 1 also has a pair of shoulder straps 9, each shoulder strap extending from a corresponding cup 5 to a back portion 11 of the band 3.

The garment 1 is formed from a number of pieces of fabric that are sewn together to form a garment having a shape generally as shown in FIG. 2. The fabric is a substantially elastic material, preferably a spandex material or an elastane material. Using fabrics with different limits of elasticity or stretch provides different levels of support to a wearer's breasts B. Highly stretchable fabrics will offer less support and greater range of movement than minimal stretch or non-stretch fabrics. The material may comprise natural fibres, manmade fibres, or a combination of natural fibres and manmade fibres. Suitable fabrics include cotton, polyester, polyamide (nylon), cotton-spandex, polyester-spandex, or polyamide-spandex, for example.

The fabric chosen for the garment will suitably be a fabric that minimises skin irritation. For decorative purposes, the garment may have lace. The lace will also be chosen to minimise skin irritation. Preferably, the lace will be applied at non-rub potions of the garment.

The band 3 is a relatively tall band formed from an elastic material. The band 3 holds the garment firmly in place against the wearer's torso T. When the garment is worn, the band 3 is nestled up under the wearer's breasts B where the breast tissue meets the chest and sits flat against the torso T. The band 3 is a relatively tall band and has a height of about 32 mm. However, it will be appreciated that the height of the band 3 is variable. Other suitable heights of the band 3 are from about 19 mm to about 60 mm. The depth of the elastic band is about 2 mm. The depth of the elastic band is also variable.

The band 3 is preferably formed from a non-roll, ribbed elastic material and is enclosed in a folded hem 13. Alternatively it could be a non-roll, elastic material suitable for wearing against the skin, without being enclosed in fabric. The band 3 is attached to the folded hem 13 by stitching. Alternatively, the band may be enclosed in the folded hem 13, but not directly attached to the folded hem with stitching. Using a non-roll elastic ensures that the band 3 sits substantially flat against a wearer's torso T and does not roll or bunch up when it is worn. The folded hem 13 is attached directly to the panel 7 by stitching. Alternatively, the folded hem may be a folded portion of the panel 7 or another part of the garment.

Figure 4:
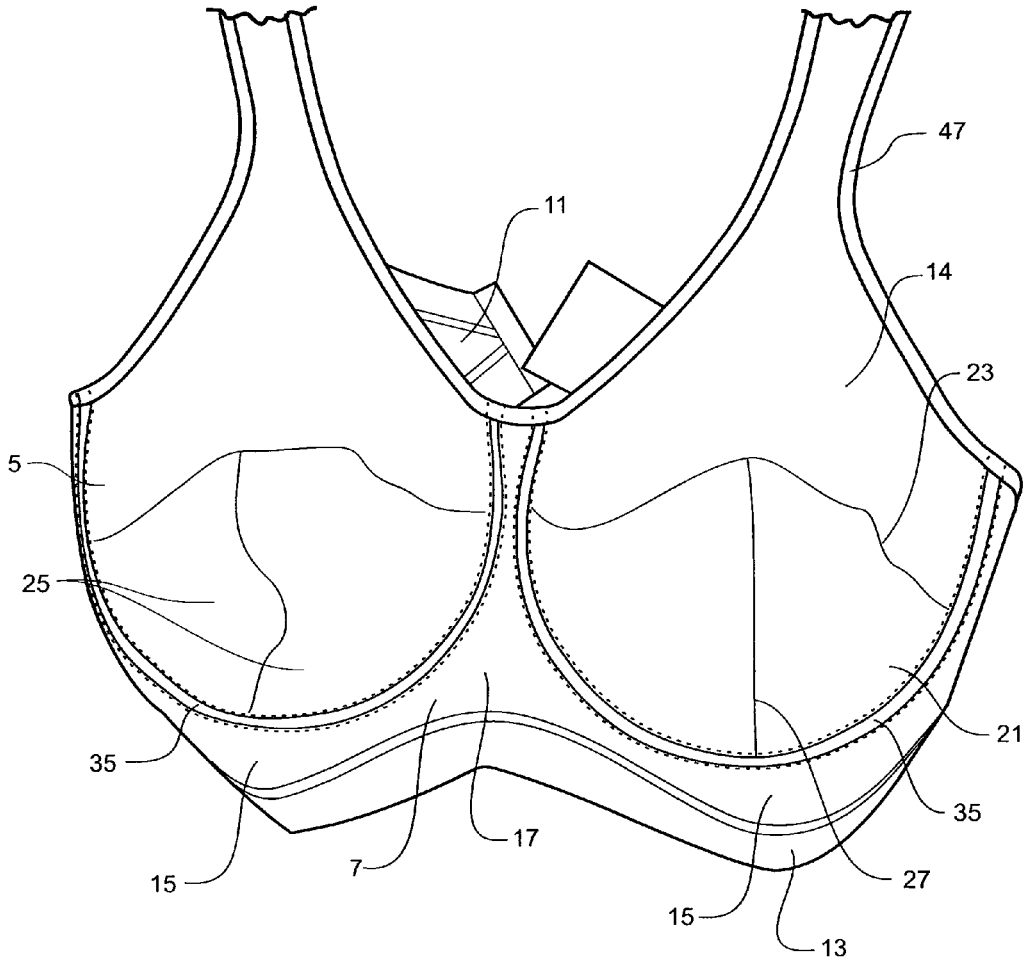
FIG. 4 is a front view of the garment for supporting a wearer's breasts of FIG. 1, not being worn, and showing the folding panel portions in an unfolded state.

The panel 7 is formed from a foldable or flexible material. FIG. 4 shows the folding panel portions in an unfolded or stretched state. When the folded portions are not being stretched, the folding portions will naturally fold to some extent, as shown in FIG. 2. When the garment 1 is worn, the folding portions may fold to a greater extent than when the garment is not worn.

Figure 7:
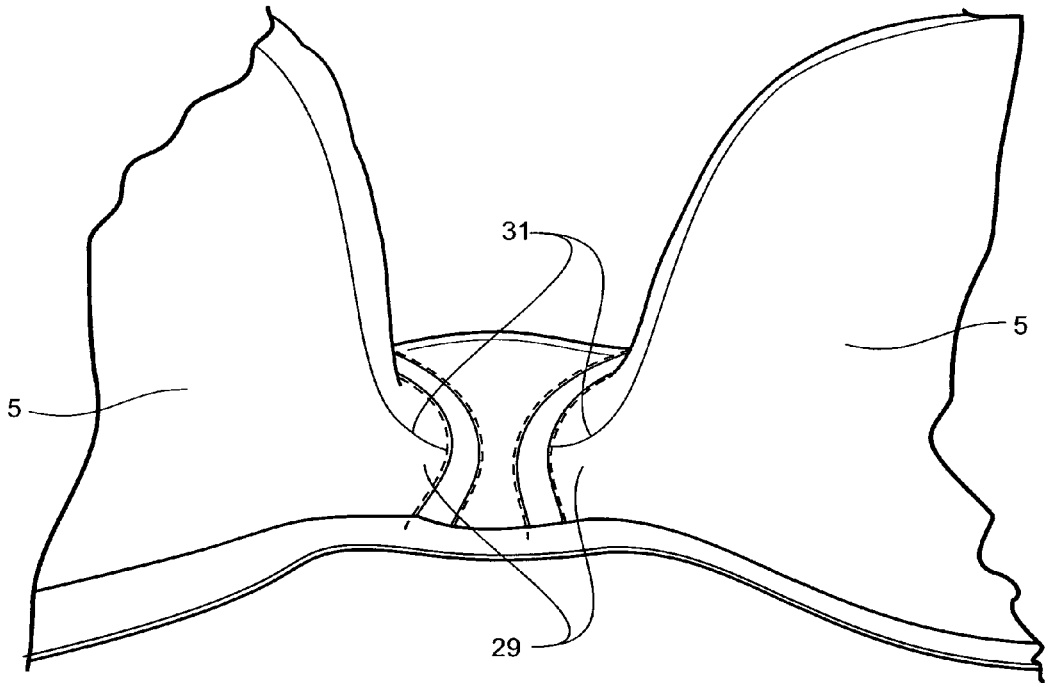
FIG. 7 is a top perspective detail view showing the sternum portion of the cups of the garment for supporting a wearer's breasts of FIG. 1.
Figure 8:
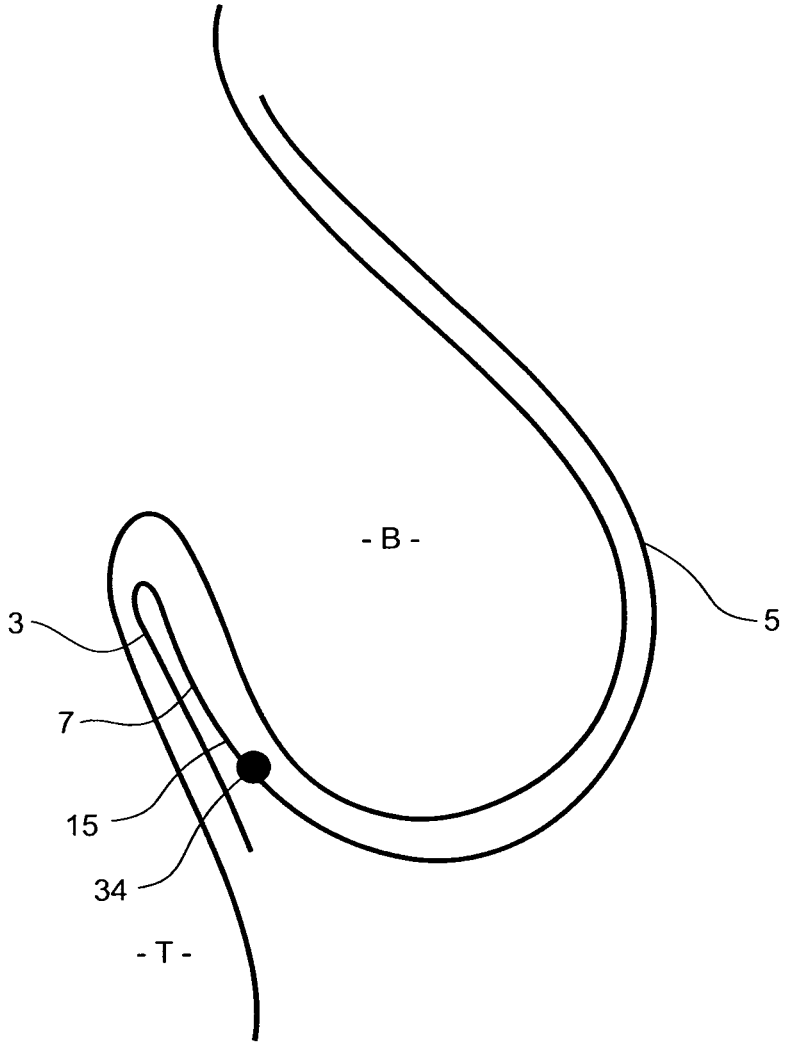
FIG. 8 is a schematic cross-sectional view of the garment for supporting a wearer's breasts of FIG. 1, as worn.

With reference to FIGS. 3A, 3B and 7, the panel 7 has folding portions 15 that are foldable in a direction towards the pair of cups 5 such that the weight of a wearer's breasts B is supported by the shoulder straps 9 and the band 3. In the embodiment shown, the panel 7 has a folding portion 15 below each cup 5.

When the garment 1 is worn, the folding portion 15 below each cup will fold, and a centre portion 17 between the folding portions 15 may also fold to some extent. The amount that the centre portion 17 will fold will depend on the amount of stretch or elasticity in the panel 7, the stiffness of the panel, and/or the relative height of the panel. In an embodiment, the centre portion 17 between the folding portions may fold the same amount that the folding portions 15 fold. In another embodiment, the centre portion 17 between the folding portions may not fold at all.

Both the band 3 and the shoulder straps 9 support the weight of the wearer's naturally drooping breast. The garment distributes the weight of each breast between those two points, rather than just one, the shoulder straps, as with a conventional bra. This reduces the stress, pain and aching of the shoulder region. The reduced weight on the shoulder strap area means the garment will minimise indented shoulder tissue, which can occur with a conventional bra. Women with naturally drooping breasts B who already have indented shoulder tissue from wearing conventional bras may be able to regain their original shoulder tissue shape by wearing a garment as described in this specification.

The cups 5 are formed from panels that are sewn together. Each cup has an upper cup portion 19 and a lower cup portion 21. The upper cup portion is the part of the cup from the fullest part of the cup upwards and the lower cup is the part of the cup from the fullest part of the cup downwards. A seam 23 extends between the upper cup portion and the lower cup. The lower cup portion has a round three-dimensional shape. The lower cup portion has a generally spherical lune-type shape. The lower cup portion is formed from panels 25 that are connected together with arcuate seams to form the round three-dimensional shape. When viewed from the side, a lower profile 33 of the cup has a generally constant radius. When viewed from the front, a lower periphery 35 of each cup 5 has a generally constant radius. In the embodiment shown, the shapes of the cups are formed by seams. However, it will be appreciated that the shapes of the cups may be formed by other methods, such as straight or arcuate darts, pleats, or folds, for example.

In the embodiment shown, the lower portion has two panels with a central arcuate seam 27. It will be appreciated that the lower portion may be formed from a single piece of material with straight or arcuate darts to form the round three-dimensional shape. Alternatively, the lower portion may be formed from more than two panels, for example, four or five panels that have arcuate seams to form the round three-dimensional shape. In another alternative, the shape may be formed by pleats, gathers, or folds, for example.

With reference to FIGS. 3A and 3B, each of the cups 5 has a lower portion that is arranged to extend at least partly over the panel 7 when the garment is worn. In the embodiment shown, the lower portion is arranged to extend over the panel 7 and over the band 3 when the garment 1 is worn. The lower portion may extend over only part of the band 3, depending on the relative sizes of the cups 5, the relative height of the panel 7, and the relative height of the band 3.

Figure 6:
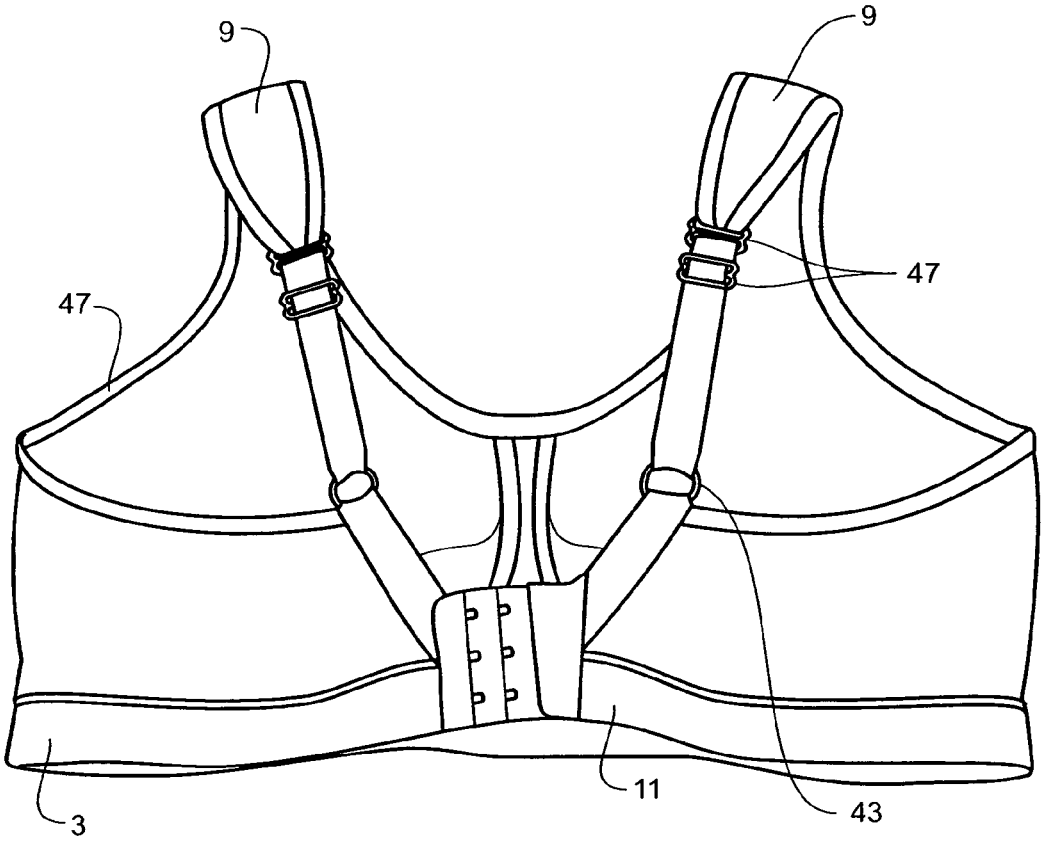
FIG. 6 is a back view of the garment for supporting a wearer's breasts of FIG. 1, not being worn.

With reference to FIG. 7, each of the cups 5 comprises a sternum portion 29 that is a relatively flat compared to the remainder of the cup. As shown in FIG. 6, the relatively flat sternum portion 29 is formed by a seam 31 between the lower portion of the cup and an upper portion of the cup. The seam 31 extends upwardly at away from seam 23, so that a first end 31*a* of the seam close to the centre of the garment is positioned higher than the second end 31*b* of the seam where it connects to seam 23. In the embodiment shown, the seam is an arcuate seam, which is concave when viewed from the upper portion of the cup. Alternatively, the seam 31 may be relatively straight. It will be appreciated that the relatively flat sternum portion 29 may be formed by other methods, such as straight or arcuate darts, for example. The sternum portion 29 is relatively flat when the garment is not worn. When the garment is worn, the sternum portion does not stay flat but moulds to the wearer's breast to separate the breasts and allow the underwires to sit flat against the wearer's chest, as shown in FIG. 3A.

As mentioned above, the various panels of the garment, including the cups 5, are formed from a substantially elastic material. The elasticity of the material helps the cups 5 to stretch to fit the wearer's breasts B.

Figure 5:
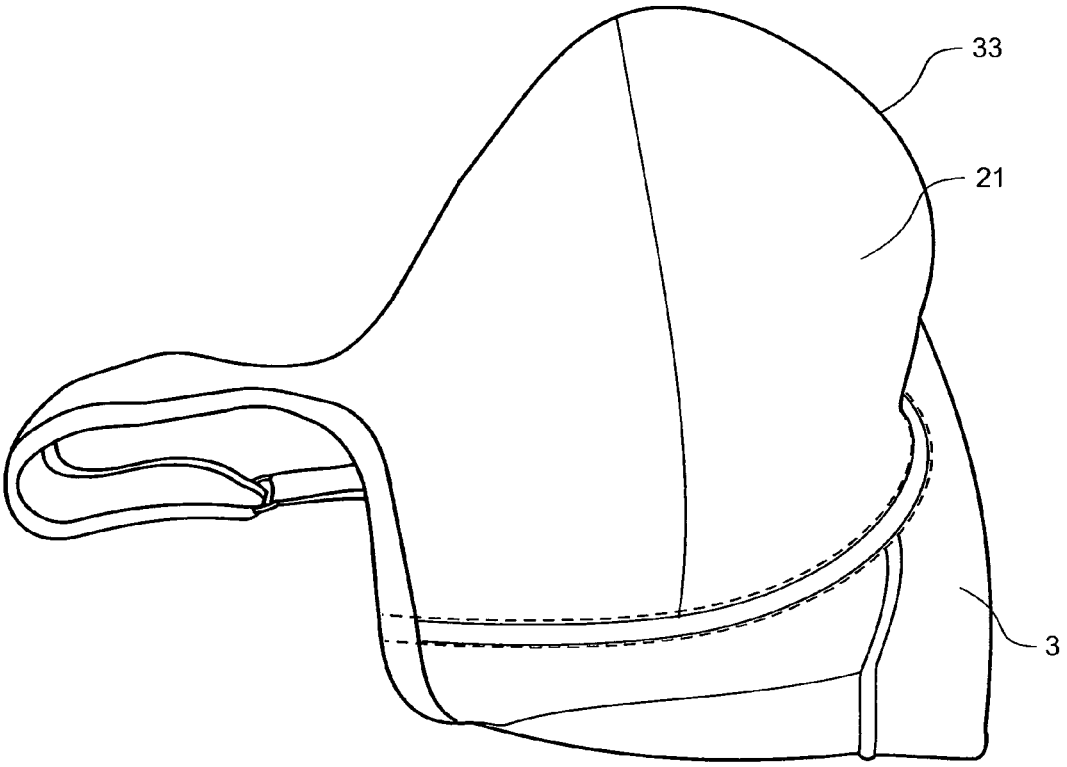
FIG. 5 is a side view of the garment for supporting a wearer's breasts of FIG. 1, not being worn.

As shown in FIGS. 2 and 5, the lower cup 21 has a generally rounded three-dimensional shape. When viewed from the side, the lower profile 33 of the cup has a generally constant radius. When viewed from the front, the lower periphery 35 of each cup 5 has a generally constant radius. Each of the cups 5 has an underwire 34 disposed about a lower periphery of each cup. The underwires perform an uplifting function and shaping function compared to the weight bearing function as in a conventional garment. In an alternative embodiment, the garment may not have an underwire.

With reference to FIGS. 3A and 3B, the lower portion of each of the cups is arranged to extend at least partly over the panel 7 when the folding portion of the panel 7 is folded. The lower portion is arranged to extend over the panel 7 and at least partly over the band 3 when the folding portion of the panel 7 is folded. With reference to FIGS. 3A and 3B, the lower portion of the cup may extend completely over and past the band 3, when the garment is worn.

The embodiment shown is formed by stitching a number of panels together with shaped seams to form the required shape of the garment. In an alternative embodiment, portions of the garment may be formed by moulding. For example, the cups 5 may be formed in a heated mould press to have the shape as shown and described.

Each of the shoulder straps 9 is substantially aligned with a centre of each of the cups 5. Each cup has a neckline perimeter portion 37 that sits below a wearer's neckline and an, underarm perimeter portion 39 that sits near a wearer's underarm, when worn. The shoulder straps 9 are positioned so that the length of the neckline perimeter portion 37 and the underarm perimeter portion 39 are about the same length. The shoulder straps 9 are positioned so that the straps attach to the cups 5 generally above the fullest part or apex of each cup, when viewing the garment from the front. That ensures that the shoulder straps 9 are placed in the same position on the wearer regardless of the size of the wearer's rib cage or their cup size. The shoulder straps 9 sit directly above the central arcuate seam 27 of the lower cup so the strap gives central support to the complete cup and thus central support to the weight of the breast. The position of the shoulder strap 9 is designed to sit in the lowest point of the natural dip in a woman's shoulder between her neck and the outer arm region.

The position of the shoulder strap 9 has two benefits. Firstly, the garment strap is closer to the neck than to the edge of the shoulder so straps very rarely fall off the wearers shoulders regardless of their movements including sports or bending over, for example. Secondly, it ensures that the widest part of the wearer's breasts B are central to the woman's body not out wide on her body ensuring that the bulk of the wearer's breast is as narrow as possible in line with the wearer's body width giving the wearer a narrowing effect of the breasts B. This means the naturally drooping breast does not splay out wider than the wearer's body as can happen with some conventional bras, which gives an uncomfortably wide breast for the wearer's arms to have to move around.

Each of the shoulder straps 9 comprises a padded portion 41. When the garment 1 is worn, the padded portion 41 sits at the top of the shoulder section to further provide added support and comfort to the wearer. The padded portion 41 may be a multi-layer bonded fabric, a multifilament fabric padding, or fabric encased silicone padding, for example. The shoulder straps 9 have two layers of fabric 43, with a padded material (not visible) between the two layers. The shoulder straps 9 are adjustable in length. The shoulder straps have rings 43 and slides 45, which allow adjustment to the length of the straps.

The edges of the garment 1 are finished with an elastic edging material 47. During construction of the garment 1, the elastic edging material 47 or parts of the elastic edging material may be stretched to a greater extent than the panels of the garment, so that when the garment is worn, the elastic edging will be in a partially stretched state. The partially stretched state assists in drawing the edges of the garment towards the wearer. The edges of the garment may additionally or alternatively be finished with a decorative edging material.

Figure 9A:
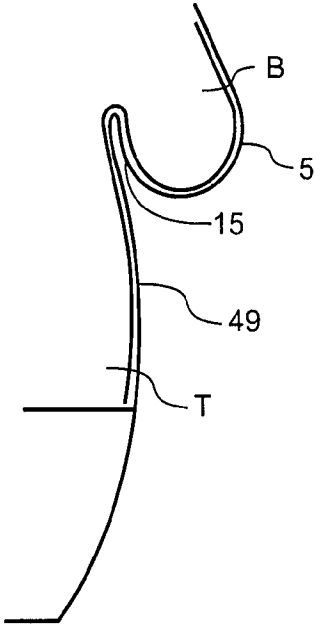
FIG. 9A is a schematic cross-sectional view of second embodiment of the garment for supporting a wearer's breasts, being worn.
Figure 9B:
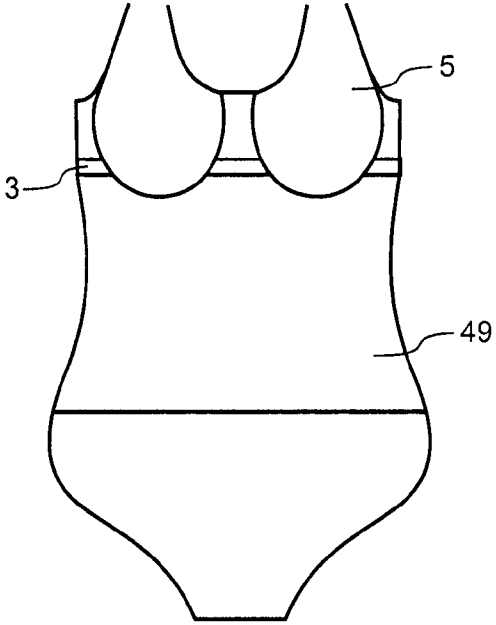
FIG. 9B is a front view of the second embodiment of FIG. 9A.
Figure 9C:
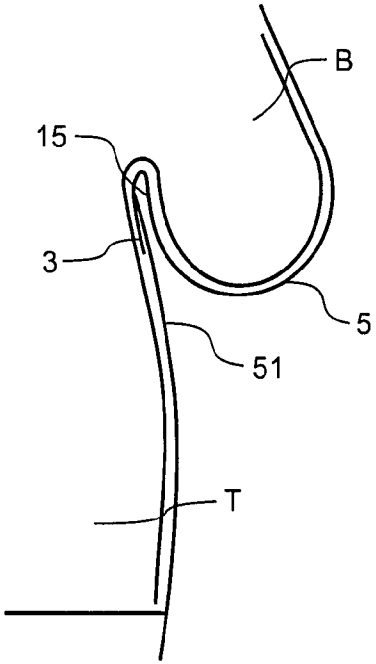
FIG. 9C is a schematic cross-sectional view of a third embodiment of the garment for supporting a wearer's breasts, being worn.

With reference to FIGS. 9A to 9C, the garment 1 may further comprise a panel extending from at or near the band in a direction substantially parallel to the band and away from the band. FIGS. 9A and 9B show a second embodiment of the garment having a panel 49 extending from a lower edge of the band 3. FIG. 9C shows a third embodiment of the garment having a panel 51 extending from above the band 3 and overlapping part or the entire band. The garment may be a corset, or a swimsuit, for example.

Figure 10B:
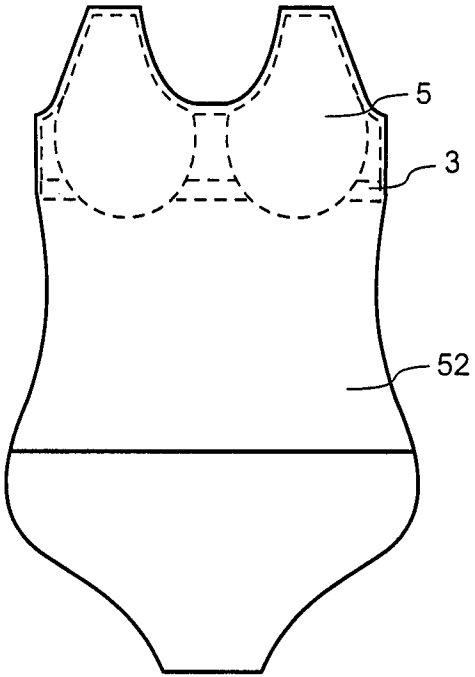
FIG. 10B is a front view of the fourth embodiment of the garment for supporting a wearer's breasts.
Figure 10A:
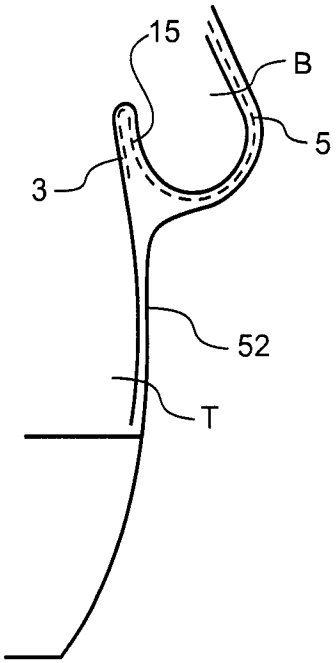
FIG. 10A is a schematic cross-sectional view of a fourth embodiment of the garment for supporting a wearer's breasts, being worn.

With reference to FIGS. 10A and 10B, the garment may further comprise a panel 52 extending over at least a major part of the pair of cups 5, over the band 3 and in a direction substantially parallel to the band and away from the band. In FIGS. 10A and 10B, the cups 5, band 3, and folding portions are shown in broken lines. The garment may be a camisole or singlet, a shirt or blouse, or a swimsuit. The shape of the panel will depend on the type of garment. For example, the panel may be draped or folded and may be a close or loose fit. The garment may be used as part of a bikini, togs, bathers or other swimsuit.

Preferred embodiments of the invention have been described by way of example only and modifications may be made thereto without departing from the scope of the invention.

For example, each of the panels of the garment has been described as comprising a single layer of material. However, it will be appreciated that the panels may be formed form two or more panels of material. The cups may comprise inner and outer layers of material with foam padding between the inner and outer layers.

In the embodiment shown, the pair of panel portions between the band and the pair of cups are integrally formed as a single panel 7. Alternatively, there may be a gap between the panel portions, or the panel portions may be stitched together.

The invention claimed is:

1. A garment for supporting a wearers breasts comprising:

a band for encircling a wearer's torso and being positioned between the wearer's breasts and torso, in use;

a pair of cups for receiving at least a major part of a wearer's breasts;

a pair of shoulder straps, each shoulder strap extending from a corresponding cup to a back portion of the garment;

and a pair of panel portions, each panel portion extending between the band and a corresponding cup of the pair of cups, each panel portion having a folding portion that is foldable relative to the pair of cups and foldable adjacent the band so that one part of the folding portion overlaps another part of the folding portion and overlaps the band such that each folding portion lies between a wearer's breasts and a wearer's torso with at least a major part of each folding portion positioned adjacent or below the band, in use;

wherein the band, the shoulder straps and the pair of panel portions are arranged such that the weight of a wearer's breasts are supported by the shoulder straps and the band.

2. A garment according to claim 1, wherein each of the cups has a lower portion that is arranged to extend at least partly over the panel portions when the folding portions of the panel portions are folded.

3. A garment according to claim 1, wherein each of the cups has a lower portion arranged to extend over the panels and at least partly over the band when the folding portions of the panel portions are folded.

4. A garment according to claim 2, wherein the lower portion of each cup has a generally rounded three-dimensional shape.

5. A garment according to claim 4, wherein the lower portion of each cup is formed from panels that are connected together with arcuate seams to form the generally rounded three-dimensional shape.

6. A garment according to claim 1, further comprising underwires with a respective underwire disposed about a lower periphery of each cup.

7. A garment according to claim 1, wherein each cup comprises a substantially elastic material.

8. A garment according to claim 7, wherein each cup comprises a spandex or elastane material.

9. A garment according to claim 1, wherein the panel portions comprises a substantially elastic material.

10. A garment according to claim 9, wherein the panel portions comprise a spandex or elastane material.

11. A garment according to claim 1, wherein each of the cups comprises a sternum portion that is a relatively flat compared to the remainder of the cup.

12. A garment according to claim 11, wherein the relatively flat sternum portion is formed by an upwardly angled seam that has a first end positioned close to the center of the garment and a second end spaced a distance away from the center of the garment, the first end being positioned higher than the second end, when the garment is viewed from the front.

13. A garment according to claim 11, wherein the relatively flat sternum portion is formed by an arcuate seam between the lower portion of the cup and an upper portion of the cup.

14. A garment according to claim 13, wherein the arcuate seam is concave when viewed from the upper portion of the cup.

15. A garment according to claim 1, wherein the band has a height of about 19 mm to about 60 mm.

16. A garment according to claim 15, wherein the band has a height of about 32 mm.

17. A garment according to claim 1, wherein the band comprises a substantially elastic material.

18. A garment according to claim 17, wherein the band comprises a non-roll substantially elastic material.

19. A garment according to claim 1, wherein the garment further comprises a folded hem encasing the band.

20. A garment according to claim 1, wherein the shoulder straps each comprise a padded portion.

21. A garment according to claim 1, wherein each of the shoulder straps is substantially aligned with a center of each of the cups.

22. A garment according to claim 1, wherein the cups are formed from two or more portions sewn together.

23. A garment according to claim 1 further comprising a panel extending from at or near the band in a direction substantially parallel to the band and away from the band.

24. A garment according to claim 23, wherein the garment is a corset.

25. A garment according to claim 23 wherein the garment is a swimsuit.

26. A garment according to claim 1 further comprising a panel extending over at least a major part of each of cups, over the band and in a direction substantially parallel to the band and away from the band.

27. A garment according to claim 26 wherein the garment is a swimsuit.

28. A method of supporting a wearer's breasts, the method comprising the steps of:

a) providing a garment having a band for encircling a wearer's torso, a pair of cups for receiving a major part of a wearer's breasts, a pair of shoulder straps, each shoulder strap extending from a corresponding cup to a back portion of the garment, and a pair of panel portions, each panel extending between the band a corresponding cup of the pair of cups, the panel having folding portions that are foldable relative to the pair of cups;

b) placing the garment on a wearer such that the band encircles a wearer's chest and is positioned between the wearer's breasts and torso, a major part of a wearer's breasts are received by the pair of cups, each shoulder strap extending over the wearer's shoulders, and each folding portion is folded adjacent the band so that one part of the folding portion overlaps another part of the folding portion and overlaps the band such that each folding portion lies between a wearer's breasts and a wearer's torso with at least a major part of each folding portion positioned adjacent or below the band; and c) supporting the weight of a wearer's breasts by the shoulder straps and the band.

29. A method according to claim 28, wherein each of the cups of the garment provided in step a) has a lower portion, the method further comprising: allowing the lower portion of each of the cups to extend at least partly over the panel when the folding portions of the panel are folded.

30. A method according to claim 28, wherein each of the cups of the garment provided in step a) has a lower portion, the method further comprising: allowing the lower portion of each of the cups to extend at least partly over the band when the folding portion of the panel is folded.

* * * * *